US010328291B2

(12) United States Patent
Alexander

(10) Patent No.: US 10,328,291 B2
(45) Date of Patent: Jun. 25, 2019

(54) SYSTEM AND METHOD FOR BREAKING GLASS

(71) Applicant: OWL SAFETY INNOVATIONS, LLC, Milton, GA (US)

(72) Inventor: A. James Alexander, Milton, GA (US)

( * ) Notice: Subject to any disclaimer, the term of this patent is extended or adjusted under 35 U.S.C. 154(b) by 153 days.

(21) Appl. No.: 15/331,976

(22) Filed: Oct. 24, 2016

(65) Prior Publication Data

US 2017/0113073 A1 Apr. 27, 2017

Related U.S. Application Data

(60) Provisional application No. 62/245,698, filed on Oct. 23, 2015.

(51) Int. Cl.
*A62B 3/00* (2006.01)
*B26F 3/00* (2006.01)

(52) U.S. Cl.
CPC ..... *A62B 3/00* (2013.01); *A62B 3/005* (2013.01); *B26F 3/00* (2013.01)

(58) Field of Classification Search
CPC ... A62B 3/00; A62B 3/005; B26F 3/00; Y10T 225/371
USPC ..... 225/1, 103
See application file for complete search history.

(56) References Cited

U.S. PATENT DOCUMENTS

| | | | | |
|---|---|---|---|---|
| 7,937,871 | B2 * | 5/2011 | Mantas | F41A 9/65 225/103 |
| D642,444 | S * | 8/2011 | Kommer | D8/105 |
| 8,661,723 | B2 * | 3/2014 | Emde | F41A 11/04 42/71.02 |
| 9,956,438 | B2 * | 5/2018 | Iversen | A62B 3/005 |
| 2005/0082331 | A1 * | 4/2005 | Yang | A62B 3/005 225/2 |

FOREIGN PATENT DOCUMENTS

WO W02015177686 A1 * 11/2015 ..... A62B 3/00

* cited by examiner

*Primary Examiner* — Ghassem Alie
(74) *Attorney, Agent, or Firm* — Richard Piercy; Mathew L. Grell; Grell & Watson Patent Attorneys LLC

(57) ABSTRACT

Disclosed herein are systems, devices, and methods for breaking safety glass comprising a support plate having first and second opposed sides, a glass breaking component configured to connect to the support plate, the glass breaking component comprising: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass. Also disclosed herein are methods for using the disclosed systems and devices.

16 Claims, 11 Drawing Sheets

SYSTEM AND METHOD FOR BREAKING GLASS

CROSS REFERENCE TO RELATED APPLICATIONS

This claims the benefit of priority to U.S. Provisional Patent Application Ser. No. 62/245,698, filed Oct. 23, 2015, which is hereby incorporated herein by reference in its entirety.

FIELD OF INVENTION

The present invention relates to systems, devices, and methods for breaking tempered safety glass; more particularly, the present invention relates to a system, device and method for breaking the safety glass in a car, more specifically the driver, passenger front and rear side door windows. The present system, devices, and method breaks tempered safety glass with less mass, blunt force and energy than current methods, systems and devices.

BACKGROUND OF THE INVENTION

Safety glass has been used in automobiles and in home windows (shower doors, etc.) for many years. Specifically, tempered safety glass has a great deal of internal stress, the center pulls the outside surfaces in from all sides. Paradoxically, the surface tension created by the heat tempering manufacturing process makes safety glass stronger and highly resistant to breaking when struck with great force. It is similar to a tightly wound spring or two-sided drum surface with condensed and compressed dual surfaces. Safety glass is set to release a lot of energy, virtually instantaneously, when the surface tension is fractured. A chain reaction is created when a surface crack directly transfers to another section releasing enough energy to travel similarly like a shock wave throughout the entire structure in a fraction of a second-time wise.

Safety glass breaking devices typically used by safety personnel, such as EMT's, firefighters and police to gain access into the interior of a vehicle involved in accidents to extricate the occupants of the vehicle, are typically spring actuated spikes, hammers or axe-like devices to break or fracture the safety glass from outside the vehicle. There are also some spring actuated, sharp tipped hardened steel spike-like devices which the owner of a vehicle can purchase for use from inside the vehicle when needed. However, for individuals involved in accidents; stress, panic, lack of time and shock may severely hinder the occupants of the vehicle to break the safety glass in the window(s) of the vehicle from inside the vehicle if the door and window(s) are jammed or inoperable.

There remains a need for a system and method for breaking the safety glass in the window of a vehicle quickly, such as when the vehicle may be submerging under water, on fire or when the occupants are in a state of panic, shock and disoriented. The occupants have to safely and with simplicity be enabled to exit the vehicle in a precise, controlled, and facilitated manner. This need and other needs are satisfied by the various aspects of the present disclosure.

SUMMARY OF THE INVENTION

In accordance with the purposes of the invention, as embodied and broadly described herein, the invention, in one aspect, relates to a system and method that enables the breaking of panels of auto safety glass. In various aspects, the disclosed system and method can provide immediate sight recognition and can be operated with the use of minimal force or strength to break the safety glass, quickly, easily and effectively.

In another exemplary aspect, the invention relates to a system for breaking safety glass, the system comprising: a support plate having first and second opposed sides, a glass breaking component configured to connect to the support plate, the glass breaking component comprising: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass.

In another exemplary aspect, the invention relates to a method for breaking safety glass, the method comprising: providing a glass breaking device, the device comprising: a support plate having first and second opposed sides, a glass breaking component configured to connect to the support plate, the glass breaking component comprising: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass; and providing the required force to the glass breaking component to drive the glass breaking portion of the member into a surface of the safety glass to thereby break or fracture the glass.

In another exemplary aspect, the invention relates to a system contained within a multi-layer substantially circular disc that may be attached to one of the glass surfaces of the window. Within the substantially circular disc are multi-layer chambers that may include a piezoelectric disc at the center. The piezoelectric disc may be covered by a safety pull tab strip. By pulling on the safety pull tab strip, the area on the top of the piezoelectric disc is activated. The system may further comprise a power source connected to the glass breaking component, for example, and without limitation, sandwiched between the piezoelectric disc is a three (3) volt Lithium ion battery wired/connected to the glass breaking component. In a further aspect, pushing on the top of the piezoelectric disc can create an electric current. In still further aspects, the electric current can be utilized to drive the piezoelectric disc tuned to a preset frequency, such as, and without limitation, about 3.9 kHz to 4 kHz. In yet further aspect, the frequency vibration can drive the disc point(s) or glass breaking portion of a member against the glass surface, transferring the resonance frequency vibration into and through the glass structure. In even further aspects, the rapid release of the resulting energy fractures the glass throughout the entire glass window body. In alternative aspects, a piezoelectric strip with a transducer on the glass edge may be directly connected to an actuator disc that vibrates the ceramic crystal array thus fracturing the entire glass surface.

In further aspects, the invention also relates to methods for using the disclosed devices and systems.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
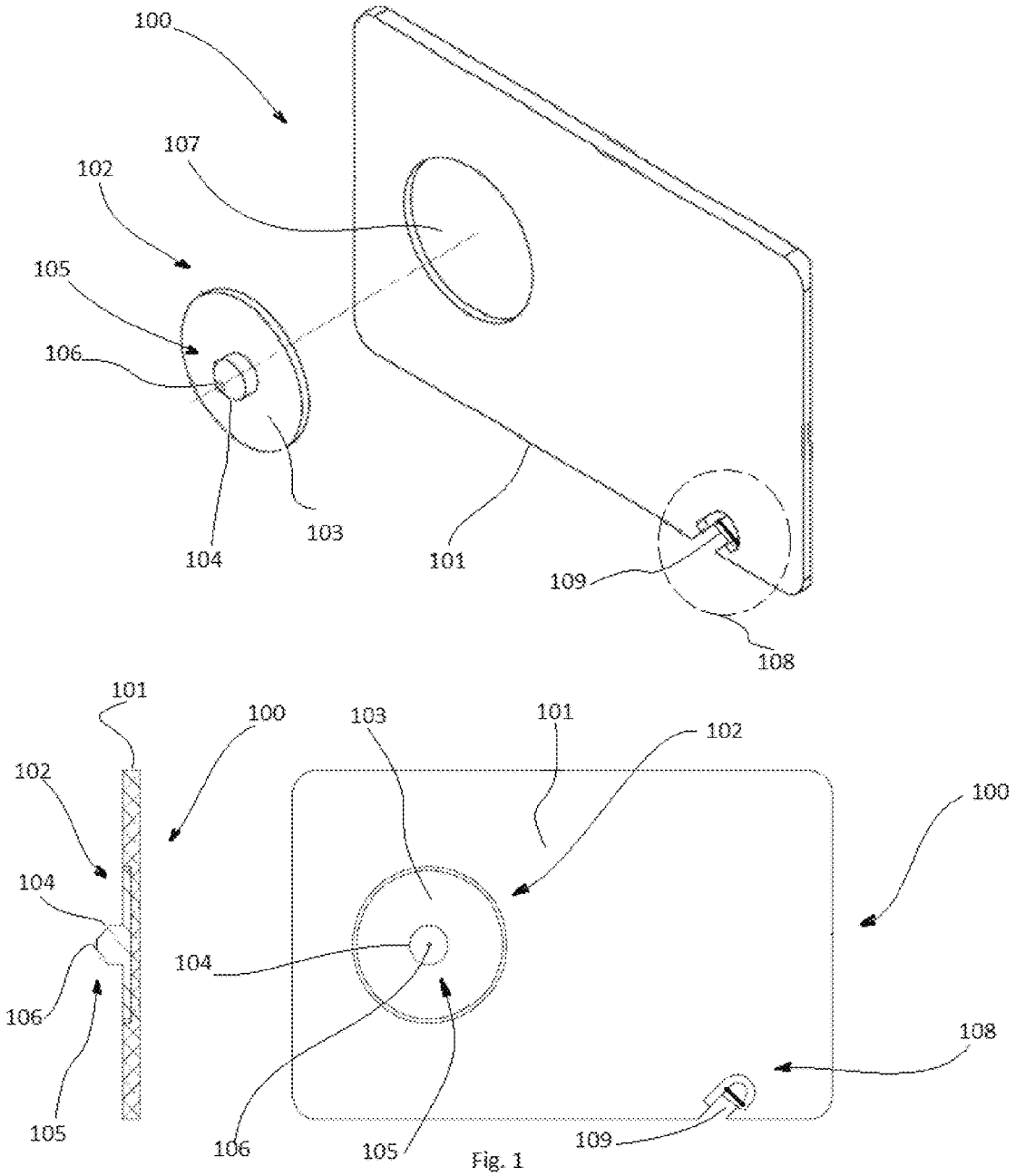
FIG. 1 shows a depiction of a glass breaking system comprising a support plate and glass breaking component in accordance with an exemplary embodiment of the present invention.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "a member" includes two or more members.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices and articles of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

B. System and Method for Breaking Safety Glass

As briefly described above, the present disclosure relates, in various aspects, to a devices and systems for breaking safety glass, such as a car window panel, or the like. In one aspect, the present disclosure provides a system for breaking safety glass, the system comprising: a support plate having first and second opposed sides, and a glass breaking component configured to connect to the support plate.

In further aspects, the glass breaking component can comprise: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass.

In various aspects, the components of the disclosed systems and devices can be releasably connected. In a further aspect, the connection can be achieved using a snap, friction fitting, snap ring, O-ring, pressure fitting, clip, clasp, and the like. The snap ring or O-ring can be retained within a groove to accommodate the snap ring or O-ring. In a further aspect, the system can comprise an engagement means for coupling and holding components together. In a further aspect, the engagement means can be a screwing mechanism, a click-lock mechanism, or friction mechanism, or the like. In still further aspects, the components can be connected by a connecting means. In yet further aspects, the connecting means can comprise a fitting, insert, fastener, adhesive, brazing, soldering, welding, spot weld, ultrasound welding, rivet, or a combination thereof.

In further aspects, the glass breaking component can be integrally or mechanically attached to the support plate. In a still further aspect, the glass breaking component can be detachably connected to the support plate. In a yet further aspect, the glass breaking component is connected to the support plate by a fitting, insert, threading, friction fit, snap-fit, adhesive, welding, or other suitable type of attachment mechanism, permanently fused or bonded, or by other features that makes the state of two mechanisms or functions mutually dependent. In further aspects, the glass breaking component can be connected to the support plate by a connecting means. In yet further aspects, the connecting means can comprise a fitting, insert, fastener, adhesive, brazing, soldering, welding, spot weld, or rivet, or a combination thereof.

In further aspects, the base of the glass breaking component can be integrally or mechanically attached to the support plate. In yet further aspects, the base of the glass breaking component can be detachably connected to the support plate. In some aspects, the first side of the base can be connected to a side of the support base. In other aspects, the second side of the base can be connected to a side of the support base.

In further aspects, the support plate can comprise a port or groove configured to receive the base of the glass breaking component. In still further aspects, the port or groove can comprise at least one side wall and a bottom wall, and wherein the walls define an open cavity configured to receive the base of the glass breaking component. In yet further aspects, the port or groove can comprise an inner cylindrical wall and a bottom wall, and wherein the walls define an open cavity configured to receive the base of the glass breaking component. In even further aspects, the base of the glass breaking component can be connected to the support plate by inserting the base into the support plate port or groove.

In further aspects, the base and the support plate port can be connected by a fitting, insert, fastener, threading, friction fit, snap-fit, adhesive, welding, or other suitable type of attachment mechanism. In still further aspects, a portion of the base can be externally threaded and the port can be internally threaded. In yet further aspects, the base can comprise an insert, and the base can be connected to the support plate by inserting the insert into the port of the support plate. In some aspects, the base can comprise a threaded insert, and the port can comprise a threaded portion, and the threaded insert can be threadably connected to the threaded portion of the port.

In further aspects, the support plate can comprise at least one aperture. In still further aspects, the at least one aperture can be configured to receive the member of the glass breaking component. In even further aspects, the bottom wall of the port can comprise a plurality of apertures. In yet further aspects, the bottom wall can comprise at least one aperture configured to receive the member of the glass breaking component, and at least one aperture configured to connect the base to the support plate by a connecting means. In still further aspects, at least one aperture can comprise a cylindrical inner wall. In some aspects, the inner wall can define an opening for receiving the member. In other aspects, the inner wall can define an opening for the connecting means.

In various aspects, the member can be connected to the first or second side of the base. In further aspects, the member can be connected to the first side of the base, and the second side of the base can be connected either side of the support base. In some aspects, the member can be connected to the first side of the base, and a side of the support plate can be connected to the first side of the base. In other aspects, the member can be connected to the first side of the base, and a side of the support plate can be connected to the second side of the base.

In further aspects, the first side of the base can be connected to a first side of the support plate, and the member can extend through an aperture from the first side of the support plate to a second side of the support plate. In still further aspects, the first side of the base can be connected to a first side of the support plate, the member can be extended through a first aperture from the first side of the support plate to a second side of the support plate, and the base can be connected to the support plate by extending a connecting means through a second aperture from the second side of the support plate to the first side of the base.

In further aspects, the base can be connected to the support plate by extending a plurality of connecting means through a plurality of second apertures from the second side of the support plate to the first side of the base. In still further aspects, the connecting means can be attached to a surface of the base.

In further aspects, the base can comprise at least one aperture. In still further aspects, the base can comprise a plurality of apertures. In yet further aspects, the aperture can be configured to receive a connecting means. In still further aspects, the base can comprise at least one aperture configured to connect the base to the support plate by a connecting means. In even further aspects, the aperture can comprise a cylindrical inner wall, and the inner wall can define an opening for the connecting means.

In further aspects, the first side of the base can be connected to a first side of the support plate, and the member can be extended through an aperture from the first side of the support plate to a second side of the support plate. In still further aspects, the base can be connected to the support plate by extending the connecting means through at least one aperture of base to the support plate. In yet further aspects, the first side of the base can be connected to a first side of the support plate, and the base can be connected to the support plate by extending the connecting means through at least one base aperture from the second side of the base to the first side of the support plate. In some aspects, the base can be connected to the support plate by extending a plurality of connecting means through a plurality of apertures of the base to the support plate. In other aspects, the base can be connected to the support plate by extending a plurality of connecting means through a plurality of apertures from the second side of the base to the first side of the support plate.

In further aspects, the glass breaking component can comprises a plurality of members. In still further aspects, the member can comprise comprises a spike, pin, needle, or included angle radius geometry, or a combination thereof. In yet further aspects, the member comprise a shaft portion disposed between the first and second ends. In even further aspects, the member can comprise a cylindrical body. In still further aspects, the member can have a height in the range of from about 10 mm to about 100 mm, including exemplary values of 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 mm.

In various aspects, the glass breaking portion can comprise any desired shape. In further aspects, the glass breaking portion can comprise a tapered or cone shape, concave, convex or any combination thereof. In still further aspects, the glass breaking portion can comprise a plurality of tapered surfaces. In yet further aspects, the glass breaking portion can have a height in the range of from about 1 mm to about 30 mm, including exemplary values of 2, 3, 4, 5, 6, 7, 8, 9, 10, 11, 12, 13, 14, 15, 16, 17, 18, 19, 20, 21, 22, 23, 24, 25, 26, 27, 28, or 29 mm. In even further aspects, the glass breaking portion can have a cone angle in the range of from about 15 degrees to about 120 degrees, including exemplary values of 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, or 119 degrees. In still further aspects, the glass breaking portion can have a taper angle in the range of from about 15 degrees to about 120 degrees, including exemplary values of 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, or 119 degrees.

In further aspects, the glass breaking portion can comprise a plurality of glass breaking edges. In still further aspects, the glass breaking portion can comprise a void. In yet further aspects, the void can comprise an inner cylindrical wall and a bottom wall. In even further aspects, the walls can define an open cavity. In yet further aspects, the upper portion of the inner wall can define a glass cutting edge.

In further aspects, the base can comprise a disc or substantially circular shape. In still further aspects, the base can have a diameter of in the range of from about 10 mm to about 100 mm, including exemplary values of 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 mm.

In further aspects, the system can have a weight in the range of from about 1 gram to about 100 grams, including exemplary values of 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 grams. In even further aspects, the glass breaking component can have a weight in the range of from about 1 gram to about 100 grams, including exemplary values of 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 grams. In still further aspects, the glass breaking component can be comprised of a hardened material. In yet further aspects, the glass breaking component can be comprised of a metal, or ceramic, or amorphous structure amalgam, or a combination thereof. In even further aspects, the glass breaking portion can be comprised of naturally occurring crystals (such as quartz, berlinite ($AlPO_4$), topaz, tourmaline-group minerals, lead titanate, or the like), synthetic crystals (such as langasite ($La_3Ga_5SiO_{14}$), gallium orthophosphate ($GaPO_4$), lithium niobate ($LiNbO_3$), lithium tantalate, or the like), synthetic ceramics (such as barium titanate ($BaTiO_3$), lead zirconate titanate, potassium niobate ($KNbO_3$), sodium tungstate ($Na_2WO_3$), $Ba_2NaNb_5O_5$, $Pb_2KNb_5O_{15}$, zinc oxide (ZnO)-Wurtzite structure, or the like), or similar materials. In even further aspects, the glass breaking portion can comprise a Rockwell harness of at least about C52.

In various aspects, the glass breaking component can comprise a piezoelectric device. In further aspects, the piezoelectric device is configured to generate an electronic frequency, such as, and without limitation, ultrasonic sound waves and the like. In still further aspects, the piezoelectric device can comprise a piezoelectric transducer, for example, an electroacoustic transducer, that can be configured to convert electrical charge into energy.

In further aspects, the glass breaking component can comprise a piezoelectric disc having one or glass breaking members attached, as described herein. In still further aspects, the glass breaking component or piezoelectric device can be configured to create, for example by using the inverse piezoelectric principle, movement of the base or disc of the glass breaking component and attached members to produce sound waves or vibration. In yet further aspects, glass breaking component can comprise a built-in oscillating circuit. In even further aspects, glass breaking component or piezoelectric device can be configured to operate over a wide temperature range. In still further aspects, glass breaking component or piezoelectric device can be configured to create sound waves in any desired range.

In various aspects, a portion of the support plate can comprise at least one recess. In further aspects, the recess can be contained within an outer edge of the support plate. In yet further aspects, a cutting mechanism can be present within the support plate. In even further aspects, the cutting mechanism can be mounted within the recess. In yet further aspects, the cutting mechanism can comprise a blade, or the like. In still further aspects, the cutting mechanism can be comprised of metal, plastic, ceramic, or a combination thereof. In some aspects, the cutting mechanism can be configured to cut a car safety belt.

In further aspects, the support plate can be comprised of plastic, metal, plastic composite, metal composite, or a combination thereof. In still further aspects, the support plate can be comprised of acrylonitrile butadiene styrene (ABS) polymer, or composite, or a combination thereof. In yet further aspects, the support plate can comprise any desired shape. In some aspects, the support plate can comprise a square or rectangular shape, such as a credit card. In other aspects, the support plate can comprise a circular shape.

In further aspects, the support plate can have a length in the range of from about 50 mm to about 100 cm, including exemplary values, such as, and without limitation, 51 mm through 99 mm. The support plate can have a length of less than about 100 mm, or 50 mm. In further aspects, the support plate can have a width in the range of from about 25 mm to about 100 mm, including exemplary values, such as, and without limitation, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 mm. In some aspects, the support plate can have a width of less than about 100 mm, or 50 mm. In other aspects, the support plate can have a length of less than about 85 mm, and a width of less than about 50 mm. In further aspects, the support plate can have a thickness in the range of from about 1 mm to about 10 mm, including exemplary values of 2, 3, 4 5, 6, 7, 8 or 9 mm. In still further aspects, the support plate can have a thickness of less than about 10 mm. In some aspects, the support plate can comprise the size of a credit card. In further aspects, the support plate can have a weight in the range of from about 1 gram to about 100 grams, including exemplary values of 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 grams.

In various aspects, the support plate is configured to be detachably attached or adhered to a surface of safety glass. In further aspects, the support plate can be configured to be detachably attached to a surface of a safety glass panel, such as, for example, a car window panel. In still further aspects, the support plate can be configured to be detachably attached to an inside surface of a safety glass panel of a car window. In yet further aspects, the support plate can be configured to be held against the glass surface of a car window by using a portion of car window structure, such as the window channel. In further aspects, the support plate can be configured to be held in place by a car window channel or trim. In some aspects, the system can further comprise an adhesion layer. In further aspects, the adhesion layer can be configured to adhere a system component to a surface of safety glass. In still further aspects, the adhesion layer can be present on a portion of the surface of the support plate.

In various aspects, the system is configured to strike a safety glass surface using the member. In further aspects, the system can be configured to drive the glass breaking portion of the member into the glass surface. In still further aspects, driving the glass breaking portion into the glass surface can be response to a user delivering the required force to the glass breaking component.

In various aspects, the present system and devices require substantially less force to break safety glass than other hand held glass breaking devices currently available. In further aspects, the required force to break the glass is less than about 10 lbs., including exemplary values of 2, 3, 4, 5, 6, 7, 8, or 9 lbs. In some aspects, the required force to break the glass is less than about 5 lbs.

In various aspects, the disclosed systems and devices can be operated to break the safety glass using a single finger or hand. In further aspects, the force can be delivered by pressing on the base of the glass breaking component. In still further aspects, the force can be delivered by pulling the support plate and glass breaking component away from the glass surface to a predetermined distance and releasing the support plate and glass breaking component, thereby causing the support plate and glass breaking component to snap back towards and strike the glass surface. In yet further aspects, when the support plate and glass breaking component strike the glass surface, the glass breaking portion can be configured to the drive the glass cutting edge or point into the glass surface, thereby fracturing the glass. In even further aspects, the predetermined distance is less than about 20 mm, including exemplary values of 2 mm through 19 mm. In some aspects, the predetermined distance can less than about 10 mm, such as 9, 8, 7, 6, 5, 4, 3, 2, 1, or even 0 mm. In further aspects, the glass cutting edge is raised off the glass surface a distance of less than about 20 mm. In other aspects, the glass cutting edge is raised off the glass surface a distance of less than about 10 mm, 9, 8, 7, 6, 5, 4, 3, 2, 1, or even 0 mm.

In some aspects, the system can further comprise a pull tab connected to the support plate. In further aspects, the pull tab can be connected to an outer edge of the support plate. In yet further aspects, the support plate can be pulled away from the glass surface using an outer edge of the support plate or a pull tab. In even further aspects, the pull pressure exerted on the outer edge of the support plate is less than about 10 lbs., 9, 8, 7, 6, 5, 4, 3, 2, or 1 lbs. In still further aspects, the pull pressure exerted on the outer edge of the support plate is less than about 5 lbs.

In various aspects, the system can further comprise one or more power sources. In further aspects, the power source can comprise a battery, capacitor, or combination thereof. In some aspects, the battery can comprise a button cell battery, for example, and without limitation, a single cell battery shaped as a cylinder typically 5 to 25 mm in diameter and 1 to 6 mm in height. In further aspects, the power source can comprise a lithium battery, alkaline battery, or the like. In still further aspects, the power source can comprise of a voltage of at least about 0.1 V, 1 V, 2 V, 3 V, 4 V, or 5 V, or more. In some aspects, the power source can comprise a 3 V lithium button cell battery.

In further aspects, the support plate can comprise at least one power source groove configured to receive the power source. In still further aspects, the power source groove can comprise at least one side wall and a bottom wall, and wherein the walls define an open cavity configured to receive the power source component. In yet further aspects, the power source groove can comprise an inner cylindrical wall and a bottom wall, and wherein the walls define an open cavity configured to receive the power source component. In even further aspects, the bottom wall of the power source groove can comprise circuitry to connect the power source to the glass breaking component. In still further aspects, the power source component can be connected to the glass breaking component by inserting the power source into the power source groove on the support plate. In further aspects, the power source is configured to produce an electric current in response to an activation or initiation step, such as, and without limitation, providing pressure. By way of non-limiting example, when there is a need to activate the device described above, the power source can be pressed or a pull tab release can be pulled to activate the device. In further aspects, the activation step can cause pressure to be placed on the glass breaking component, such as a piezoelectric disc, to thereby cause it to emit an electric current. In some aspects, the electric current can pass through the circuitry. In further aspects, the release of the energy within the device can cause the glass breaking component to move and contact the surface of the safety glass. In still further aspects, the movement force can be sufficient to release the surface tension of the safety glass and to cause the safety glass to spall or crack, thus creating cracks which enable breaking through the panel of safety glass easily.

In still further aspects, the system can comprise devices, components, equipment, and/or circuitry for electrical communication and controlling operation of one or more glass breaking component. In even further aspects, the power source can be configured to power the circuitry of essential components of the system to allow the glass breaking component to operate to break the safety glass. In still further aspects, the circuitry can be connected to the glass breaking component. In yet further aspects, the circuitry can be located on a surface of or embedded within the support plate, or a combination thereof.

Furthermore, embodiments of the disclosure may be practiced in an electrical circuit comprising discrete electronic elements, packaged or integrated electronic chips, or a circuit utilizing one or more power sources connected to the glass breaking component, or a combination thereof. In further aspects, embodiments of the disclosure may also be practiced using other technologies capable of performing electrical or mechanical operations such as, for example, AND, OR, and NOT, including but not limited to mechanical, optical, fluidic, and quantum technologies.

In various aspects, the system is configured to break, spall or fracture a surface of safety glass. In further aspects, an entire glass panel can be fractured with a single use of the system. In still further aspect, the entire glass panel can be fractured in less than about 0.5 seconds. In some aspects, the entire glass panel can be fractured in less than about 0.3 seconds, or even 0.2 or 0.1 seconds. In further aspects, the system utilizes a resonance frequency to fracture the glass panel. In still further aspects, the frequency can be a low-end frequency, such as, for example, 4 kHz. In yet further aspects, the system can use harmonic utilization of increasing sine wave amplitude for initiation of wave fracturing. In even further aspects, the harmonic can be the $1^{st}$, $3^{rd}$, $5^{th}$, $7^{th}$, $9^{th}$, or $11^{th}$, or a combination thereof.

In further aspects, the system can use ultrasonic frequency for initiation of wave fracturing. In still further aspects, the ultrasound frequency can be delivered using a piezo ceramic member. In yet further aspects, the ultrasound frequency for initiating spontaneous fracturing can be 8 kHz, 12 kHz, 16 kHz, or 20 kHz, or a combination thereof.

In various aspects, the support plate and the glass breaking component can comprise alternative configurations and components. For example, according to other aspects of the disclosure, the support plate can comprise a nitinol sheet and the glass breaking component can comprise embedded circular ceramic crystal array or hardened inlay may be connected to the glass edge and connected to a wired inlay on the glass similar to a "defrosting line". In further aspects, the austenite phase of the nitinol can be initiated to constrict (push) and pull on the glass surface to score and create a fracturing of the entire glass surface. In some aspects, the glass breaking component can comprise a piezoelectric strip with a transducer on the glass edge, and may be directly connected to an actuator disc that vibrates a ceramic crystal array or other capable glass breaking material thus fracturing the entire glass surface.

In various further aspects, the present disclosure also relates, to methods of using the disclosed systems and devices. In further aspects, the disclosure provides a method for break safety glass, the method comprising the steps of: a) providing a disclosed glass breaking system or device, and b) providing instructions for operating the system or device. For example, the operating instructions can comprise instructing a user to a) attach the system or device to a surface of safety glass, and b) providing the required force to the glass breaking component to drive the glass breaking portion of the member into a surface of safety glass. The system and method can further comprise one or more stickers or marks to identify a preferred installation location or position on the window or safety glass.

In another aspect, the present disclosure also provides a method for breaking glass, the method comprising the steps of: a) providing a glass breaking device, the device comprising: a support plate having first and second opposed sides, a glass breaking component configured to connect to the support plate, the glass breaking component comprising: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass; and b) providing the required force to the glass breaking component to drive the glass breaking portion of the member into a surface of the safety glass.

In further aspects, the method can further one or more of the following steps: attaching the support plate to a surface of a safety glass; attaching the support plate to a surface of a safety glass panel on the inside of a car window; attaching the support plate the glass surface using a car window structure; attaching the support plate to the glass surface using a car window channel or trim; or pressing on the base of the glass breaking component; pulling the support plate and glass breaking component away from the glass surface to a predetermined distance and releasing the support plate and glass breaking component, thereby causing the support plate and glass breaking component to snap back towards and strike the glass surface.

In various aspects, the disclosed devices, systems, and methods provide numerous advantages over current safety glass breaking devices. In further aspects, the disclosed devices, systems, and methods provide new solutions for breaking safety glass unable to be achieved using current glass breaking devices and methods. In one aspect, the present devices, systems and methods can allow a user to break safety glass using single hand or even single finger operation. For example, once the device is positioned against the inside of the car window, a user simply needs to press the device or slightly lift and release the support plate to operate the device to break the safety device. To this end, the disclosed devices and systems advantageously require no moving parts, less mass and less force to effectively break safety glass. Furthermore, the disclosed devices and system are configured to have a compact size, and to be able to convenient carry and/or store. Significantly, due to its ease of use, the disclosed devices, systems, and methods can be more effective in breaking safety glass during high stress situation or when a user is in a state of shock, such as when a car is submerged in water or the like.

BRIEF DESCRIPTION OF THE DRAWINGS

According to various aspects of the invention, the devices and systems can comprise multiple configurations. For example, various exemplary embodiments of the inventive glass breaking devices and systems are shown in FIGS. 1-16.

In further aspects, FIG. 1 shows various views of an exemplary system 100 for breaking safety glass, the system comprising: a support plate 101 having first and second opposed sides, a glass breaking component 102 configured to connect to the support plate, the glass breaking component comprising: a base 103 having first and second opposed sides, and a member 104 having first and second opposed ends, the first end of the member connected to and extending from at least one side of the base and the second end of the member comprising a glass breaking portion 105, the glass breaking portion having at least one glass cutting edge 106 and configured to break safety glass. In this exemplary embodiment, the support plate comprises a port 107 configured to receive the base of the glass breaking component, and a portion of the support plate comprises a recess 108, the recess being contained within an outer edge of the support plate. Here, the port comprises an inner cylindrical wall and a bottom wall, and the walls define an open cavity configured to receive the base of the glass breaking component, and a cutting mechanism 109 mounted within the recess. As shown in FIG. 1, the base of the glass breaking component can be connected to the support plate by inserting the base into the support plate port, and the cutting mechanism can be used to cut a car safety belt by sliding the belt against cutting mechanism.

Figure 2:
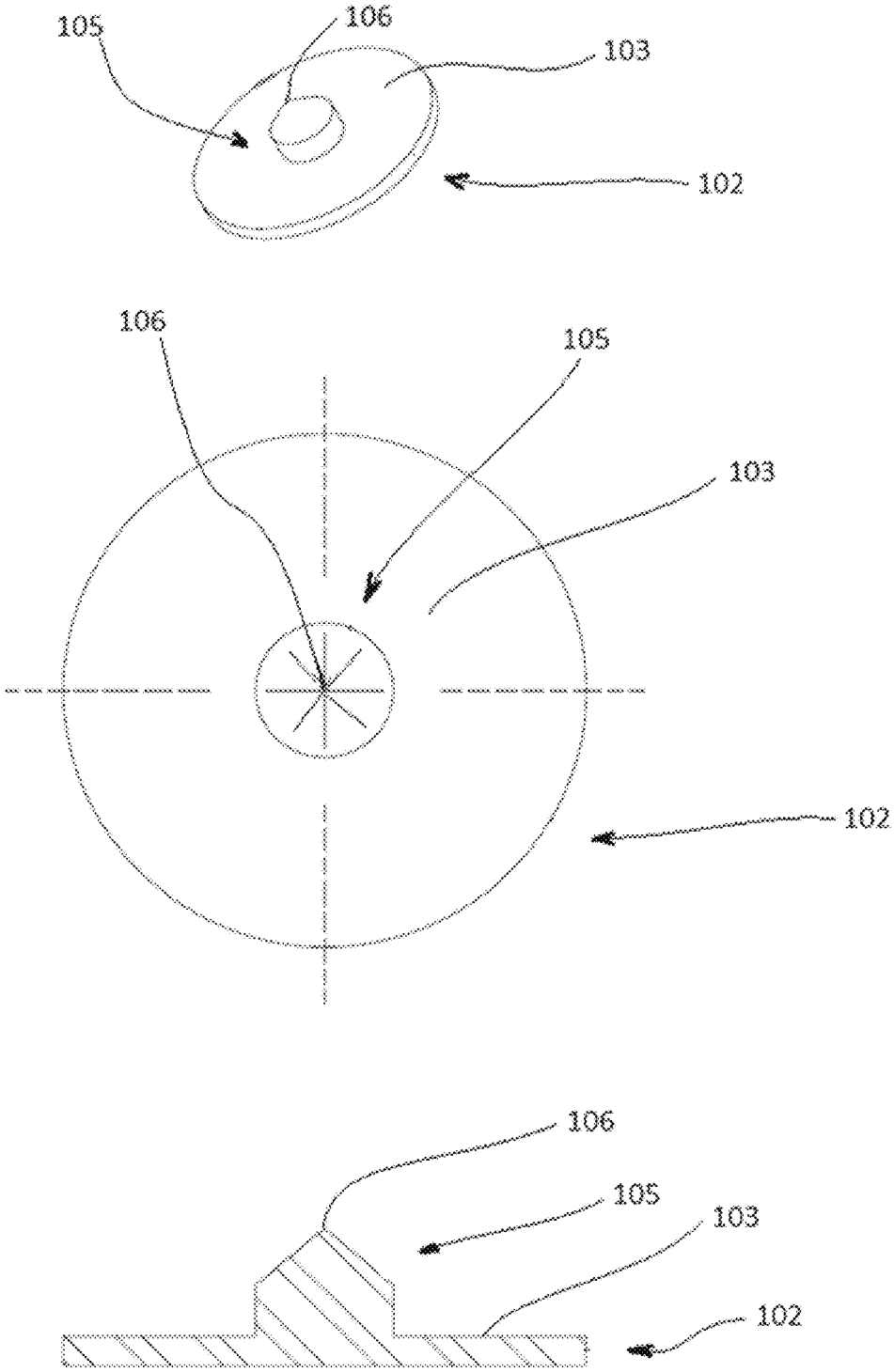
FIG. 2 shows a depiction of a glass breaking component in accordance with an exemplary embodiment of the present invention.
Figure 3:
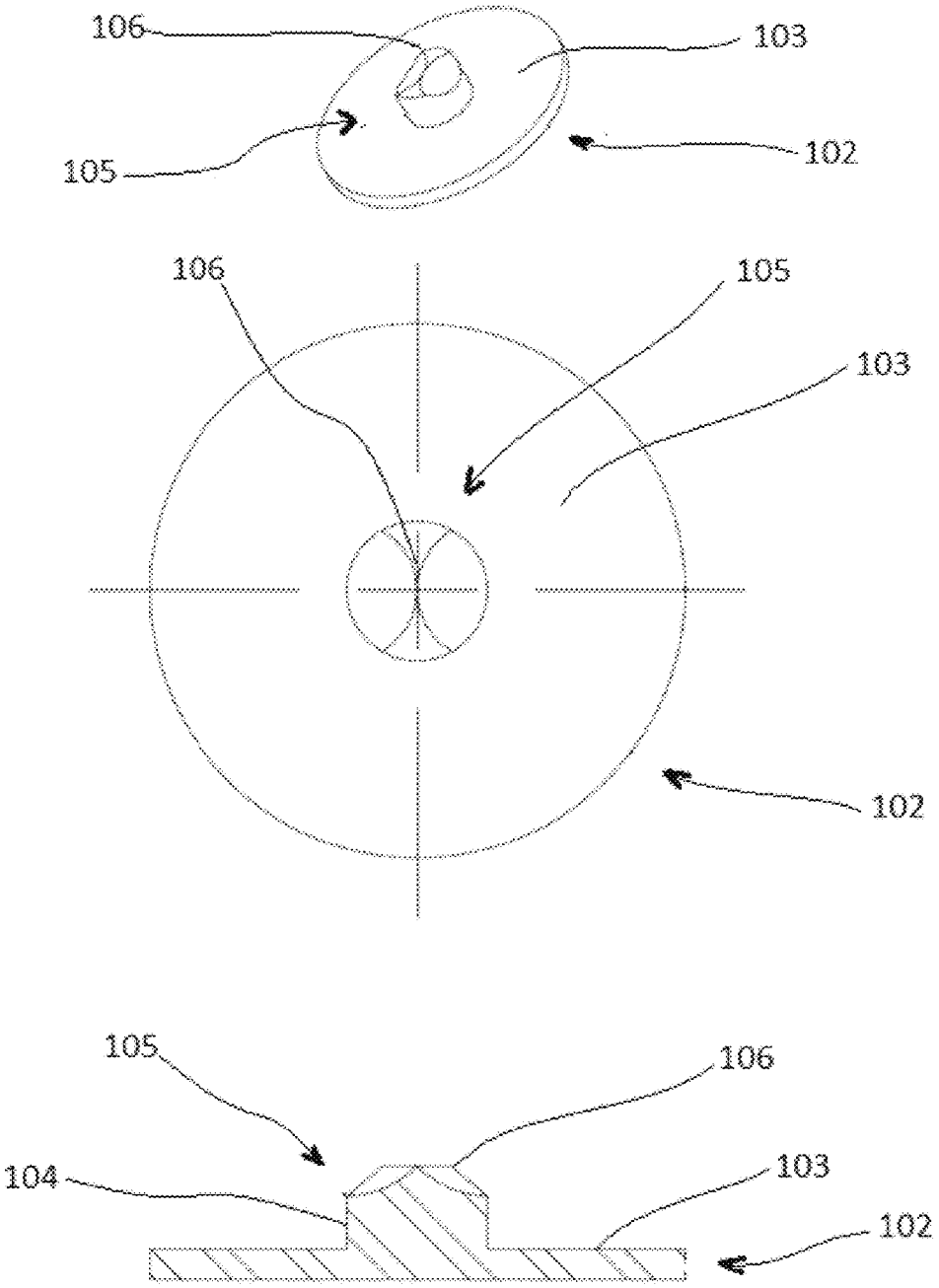
FIG. 3 shows a depiction of a glass breaking component in accordance with an exemplary embodiment of the present invention.
Figure 4:
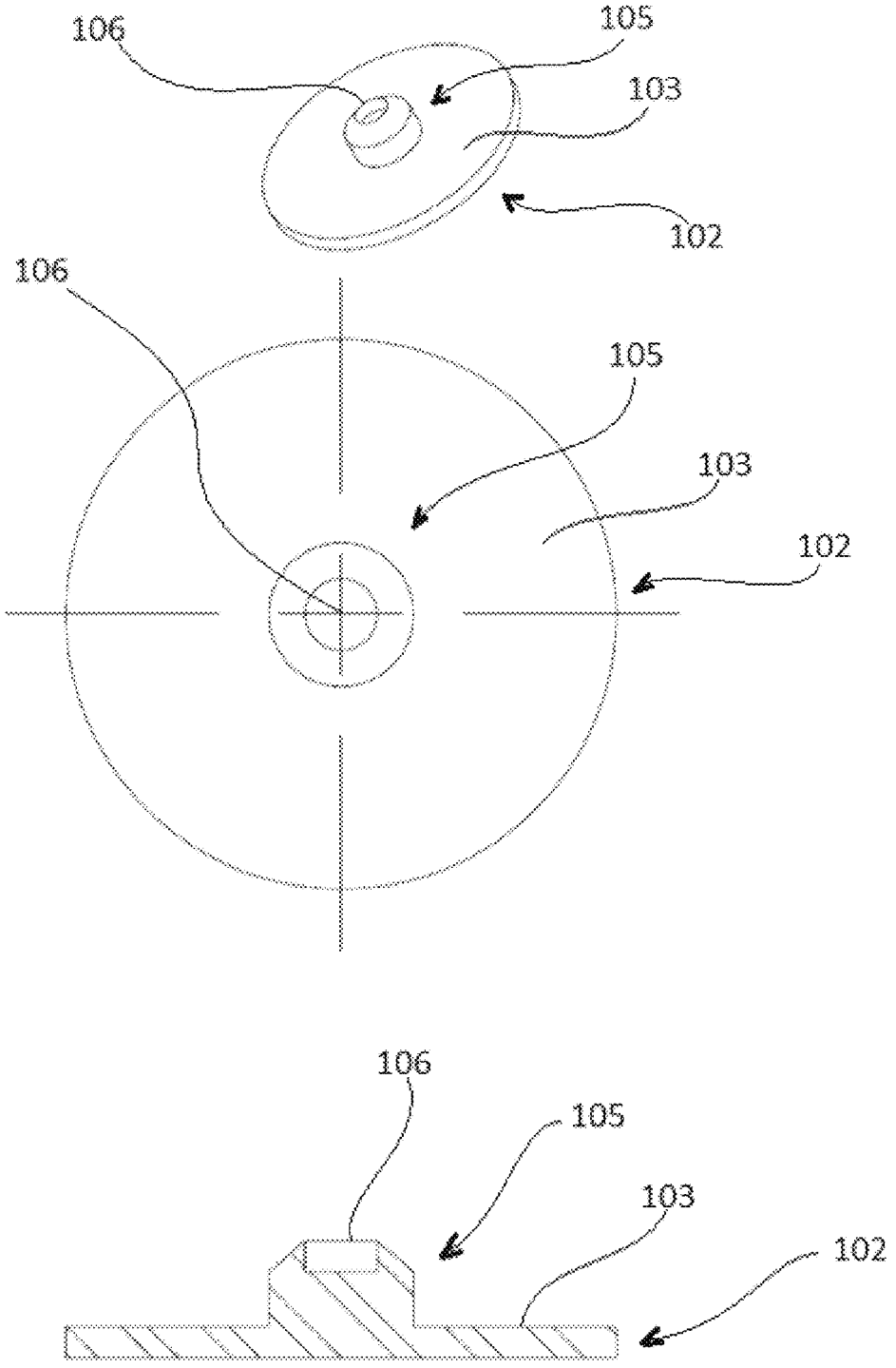
FIG. 4 shows a depiction of a glass breaking component in accordance with an exemplary embodiment of the present invention.
Figure 5:
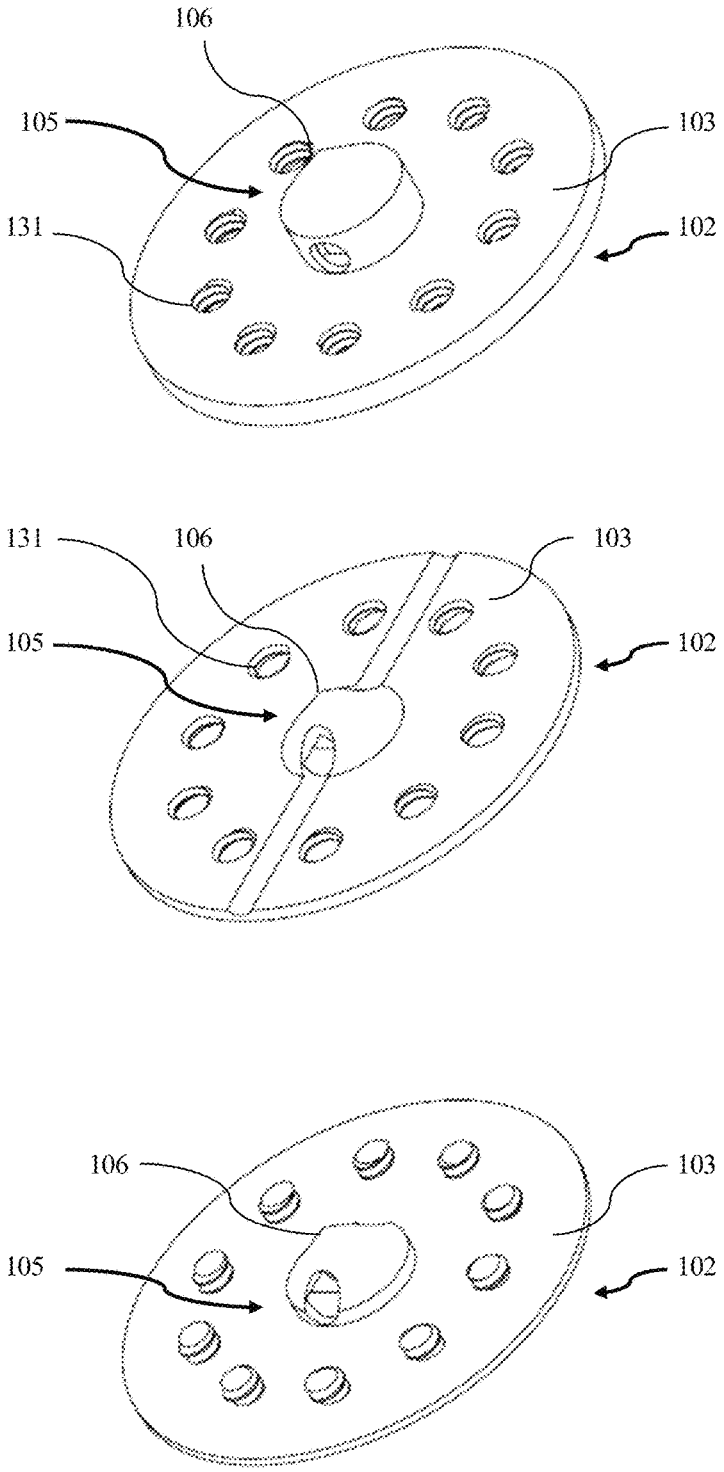
FIG. 5 shows a depiction of glass breaking components in accordance with an exemplary embodiment of the present invention.

FIGS. 2-5 show various views of exemplary glass breaking components, the glass breaking components 102 configured to connect to the support plate, the glass breaking components comprising: a base 103 having first and second opposed sides, and a member 104 having first and second opposed ends, the first end of the member connected to and extending from at least one side of the base and the second end of the member comprising a glass breaking portion 105, the glass breaking portion having at least one glass cutting edge 106 and configured to break safety glass. As shown in FIG. 2, this exemplary embodiment has a member with a cone-shaped glass breaking portion and a single glass cutting edge in the form of a point. As shown in FIG. 3, this exemplary embodiment has a member with several tapered areas glass breaking portion and a plurality of glass cutting edges. As shown in FIG. 4, this exemplary embodiment has a member with a tapered glass breaking portion with a void, the void comprising an inner cylindrical wall and a bottom wall, and defining an open cavity. As shown in FIG. 4, the upper portion of the inner wall defines the glass cutting edge. As shown in FIG. 5, the base of glass breaking component can comprise at least one aperture 131 configured to connect the base to the support plate by a connecting means.

Figure 6:
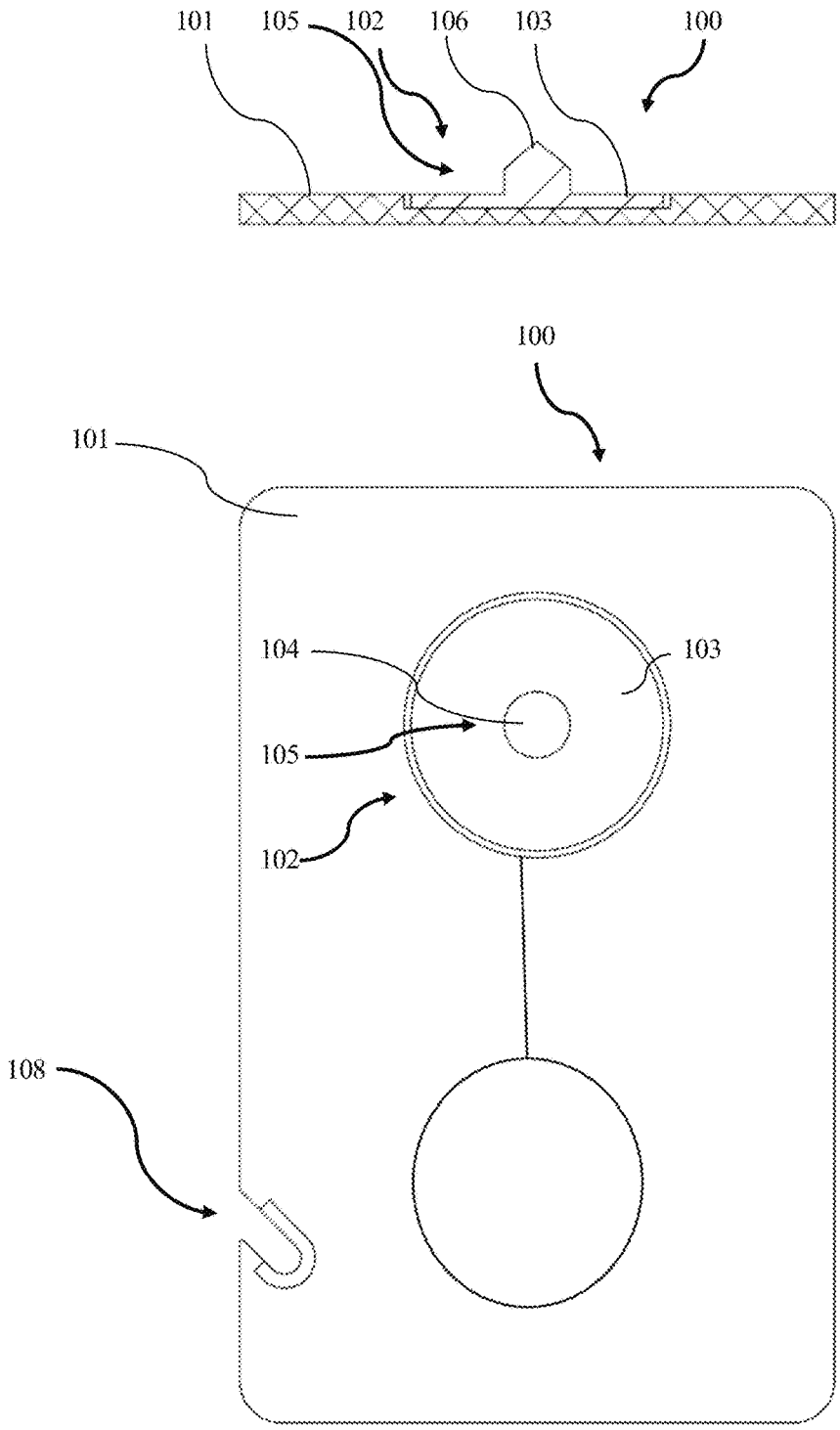
FIG. 6 shows a depiction of a glass breaking system comprising a support plate, glass breaking component, and power source in accordance with an exemplary embodiment of the present invention.
Figure 7:
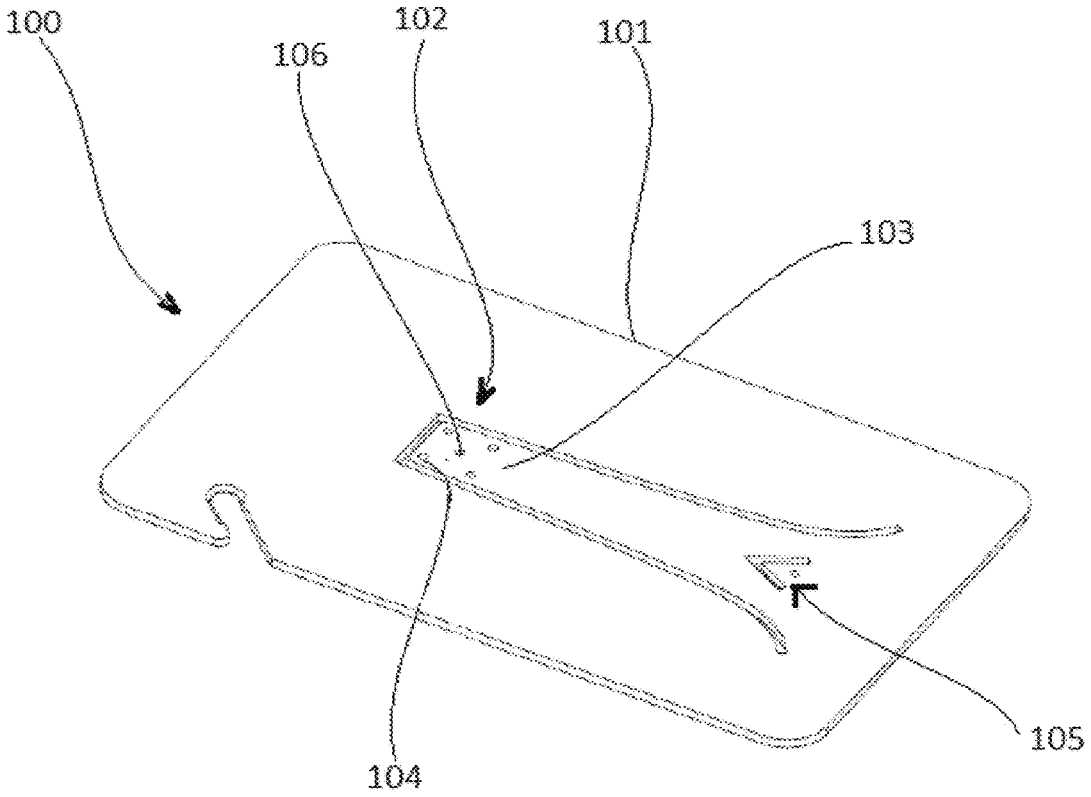
FIG. 7 shows a depiction of a glass breaking system comprising a support plate, glass breaking component, and power source in accordance with an exemplary embodiment of the present invention.

In further aspects, FIGS. 6-7 shows various views of exemplary systems 100 for breaking safety glass, the system comprising: a support plate 101 having first and second opposed sides, a glass breaking component 102 configured to connect to the support plate, the glass breaking component comprising: a base 103 having first and second opposed sides, and a member 104 having first and second opposed ends, the first end of the member connected to and extending from at least one side of the base and the second end of the member comprising a glass breaking portion 105, the glass breaking portion having at least one glass cutting edge 106 and configured to break safety glass. In this exemplary embodiment, the support plate comprises a port 107 configured to receive the base of the glass breaking component, a power source 111 and a power source groove configured to receive the power source, and a portion of the support plate comprises a recess 108, the recess being contained within an outer edge of the support plate. Here, the port comprises an inner cylindrical wall and a bottom wall, and the walls define an open cavity configured to receive the base of the glass breaking component, and a cutting mechanism 109 mounted within the recess. As shown in FIG. 6, the base of the glass breaking component can be connected to the support plate by inserting the base into the support plate port, and the cutting mechanism can be used to cut a car safety belt by sliding the belt against cutting mechanism. Further, the glass breaking component comprises a piezoelectric disc having one or glass breaking members attached and electrically connected to the power source. The glass breaking component is configured to create movement of the base or disc of the glass breaking component and attached members to produce sound waves or vibration. As shown in FIG. 7, the glass breaking portion can comprise a plurality of members.

Figure 8:
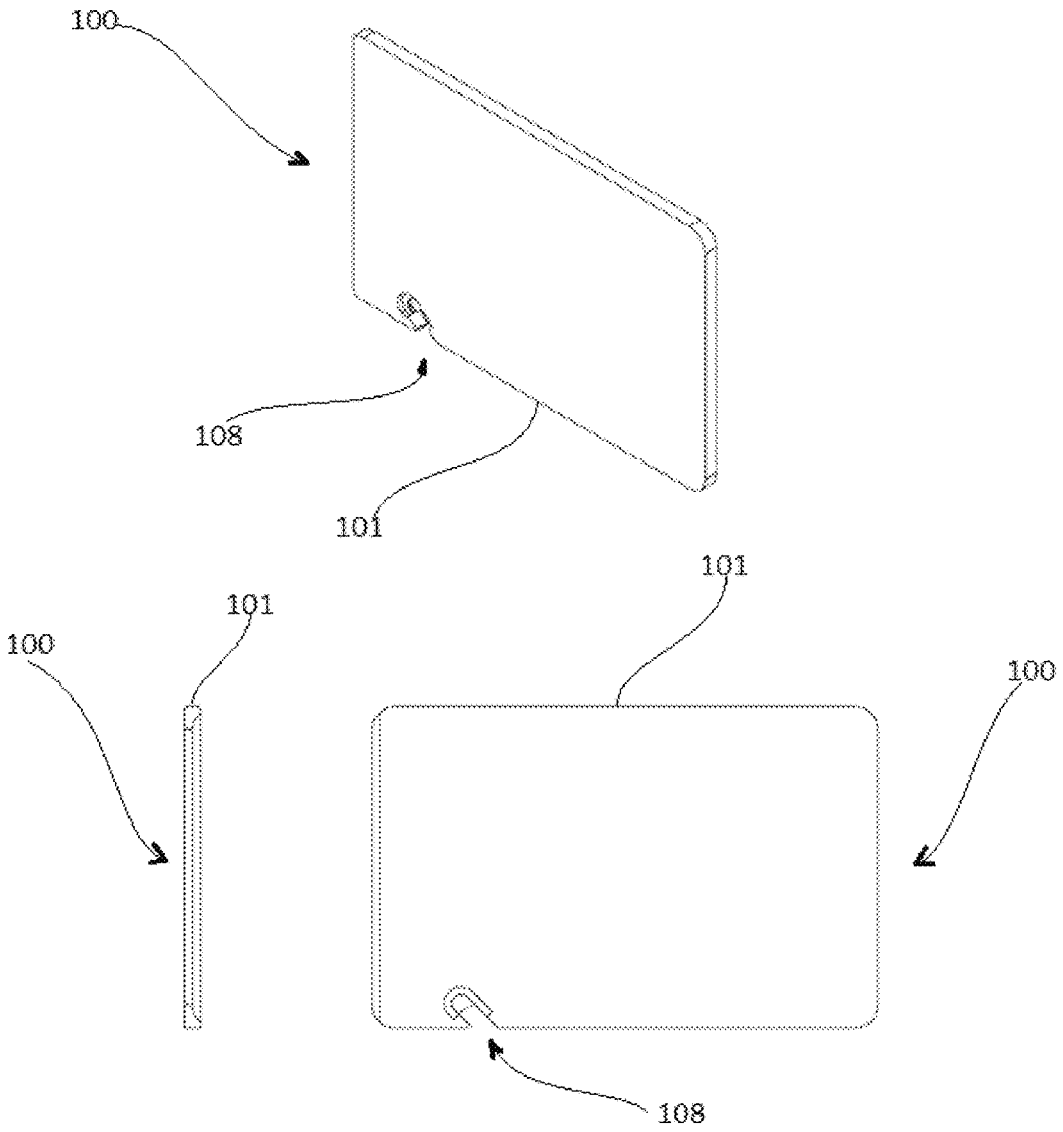
FIG. 8 shows a depiction of a support plate in accordance with an exemplary embodiment of the present invention.
Figure 9:
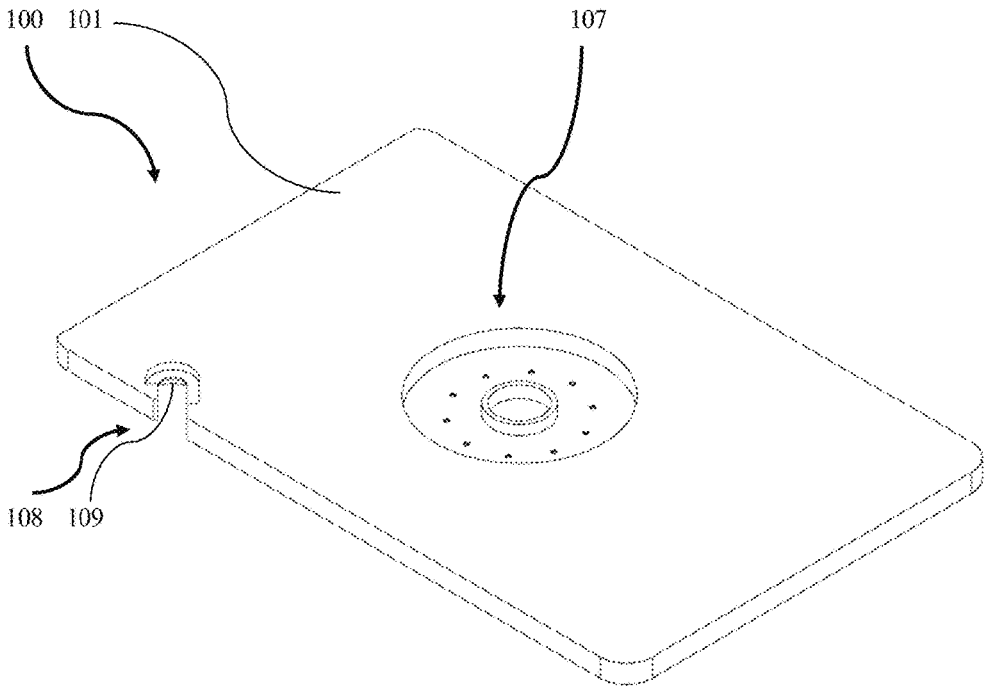
FIG. 9 shows a depiction of a support plate in accordance with an exemplary embodiment of the present invention.

In further aspects, FIGS. 8-9 show various views of support plates 101 having first and second opposed sides. As shown in FIG. 9, the support plate comprises a port 107 configured to receive the base of the glass breaking component, and a portion of the support plate comprises a recess 108, the recess being contained within an outer edge of the support plate. Here, the port comprises an inner cylindrical wall and a bottom wall, and the walls define an open cavity configured to receive the base of the glass breaking component a plurality of apertures 121 configured to receive the member of the glass breaking component and to connect the base to the support plate by a connecting means 122; and a cutting mechanism 109 mounted within the recess.

Figure 10:
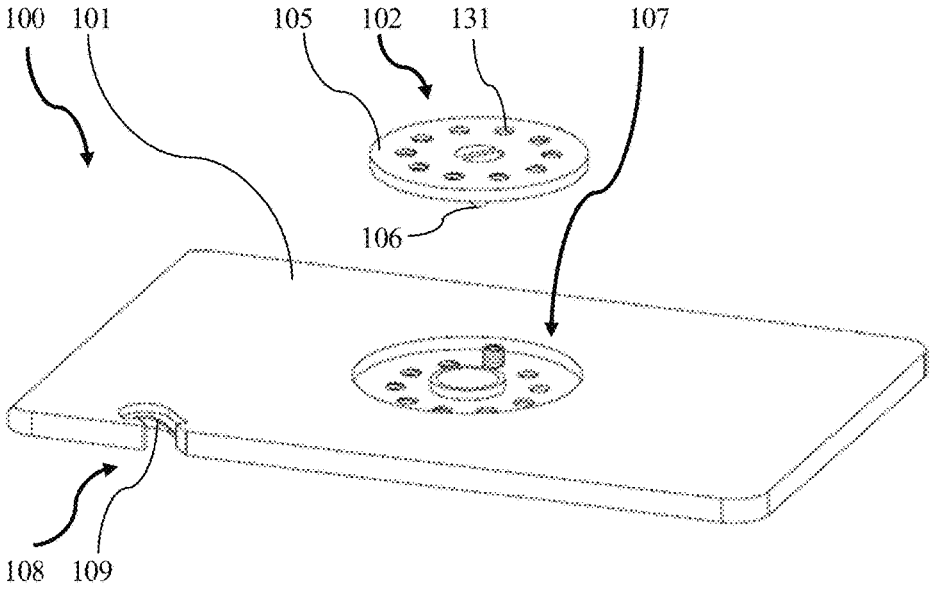
FIG. 10 shows a depiction of a glass breaking system comprising a support plate and glass breaking component in accordance with an exemplary embodiment of the present invention.

In further aspects, FIG. 10 shows various views of an exemplary system 100 for breaking safety glass, the system comprising: a support plate 101 having first and second opposed sides, a glass breaking component 102 configured to connect to the support plate, the glass breaking component comprising: a base 103 having first and second opposed sides, and a member 104 having first and second opposed ends, the first end of the member connected to and extending from at least one side of the base and the second end of the member comprising a glass breaking portion 105, the glass breaking portion having at least one glass cutting edge 106 and configured to break safety glass. In this exemplary embodiment, the support plate comprises a port 107 configured to receive the base of the glass breaking component, and a portion of the support plate comprises a recess 108, the recess being contained within an outer edge of the support plate. Here, the port comprises an inner cylindrical wall and a bottom wall, and the walls define an open cavity configured to receive the base of the glass breaking component a plurality of apertures 121 configured to receive the member of the glass breaking component and to connect the base to the support plate by a connecting means 122; and a cutting mechanism 109 mounted within the recess. As shown in FIG. 10, the base of the glass breaking component can be connected to the support plate by inserting the base into the support plate port, and the cutting mechanism can be used to cut a car safety belt by sliding the belt against cutting mechanism.

Figure 11:
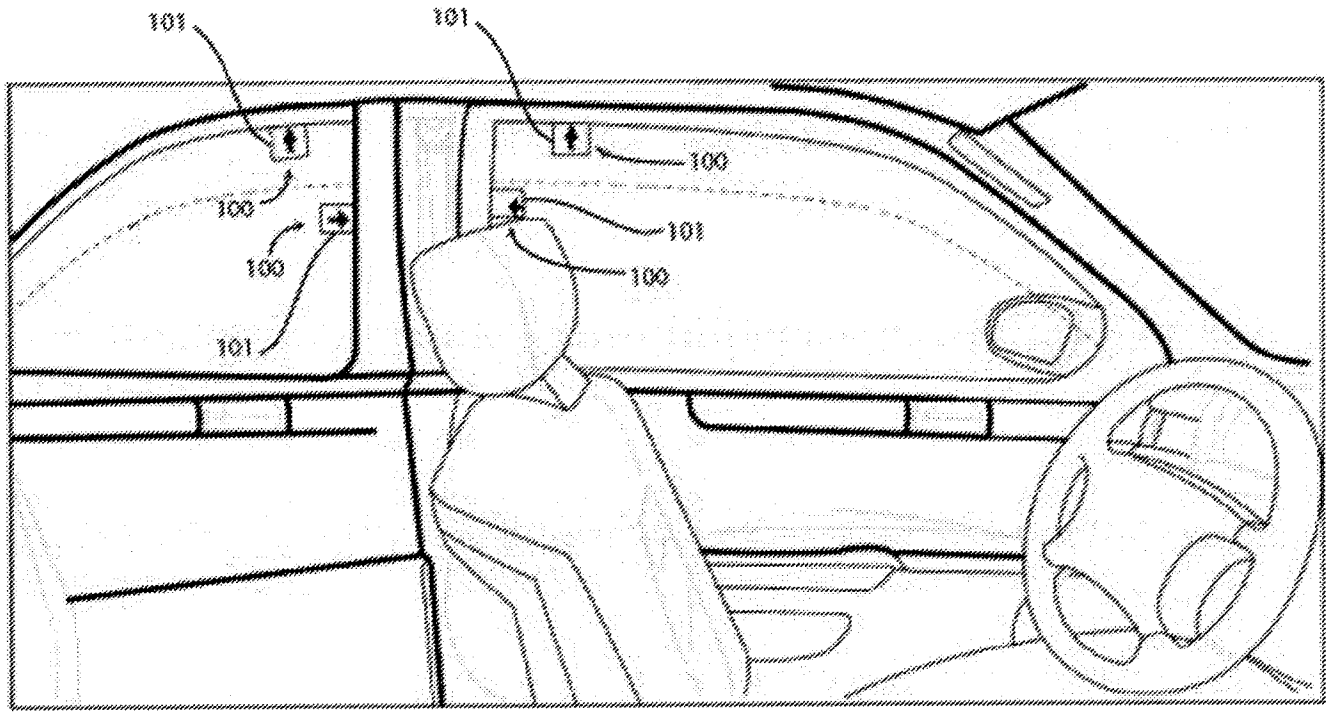
FIG. 11 shows a depiction of an automobile with the disclosed system installed in exemplary positions inside of a car side window in accordance with an exemplary embodiment of the present invention.

In various further aspects, FIG. 11 shows a method for using the disclosed devices and system to break safety glass. As shown in FIG. 11, side elevational of the side of an automobile with the disclosed system installed in exemplary positions inside of the driver's side windows (FIG. 11) and/or passenger's window. As shown, the thickness of the device is thin enough to not interfere with the up and down travel of the window. Furthermore, the system can further comprise a sticker or mark to be placed on the window location for quick identification of the position where the device can be installed. While it has been found that one of the disclosed devices for breaking safety glass mounted on the inside of a car window, more than one device may be used without substantially obscuring the vision of the driver through the driver's side window. As shown in FIG. 11, the method for breaking safety glass, can comprise installing a disclosed glass breaking device or system, and providing the required force to the glass breaking component to drive the glass breaking portion of the member into a surface of the safety glass. The device can comprise attaching the support plate to a surface of a safety glass panel on the inside of a car window, for example, attaching the support plate the glass surface using a car window structure, such as, by using the car window channel or trim. The force can be provided by pressing on the base of the glass breaking component or by pulling the support plate and glass breaking component away from the glass surface to a predetermined distance and releasing the support plate and glass breaking component, thereby causing the support plate and glass breaking component to snap back towards and strike the glass surface. As shown in FIG. 11, when the support plate and glass breaking component strike the glass surface, the glass breaking portion is configured to the drive the glass cutting edge into the glass surface, thereby fracturing the safety glass. The force can be provided using a single finger or hand, and can be less than about 10 lbs. The device can break the entire panel with a single operation and in less than about 0.5 seconds.

The disclosed devices and systems include at least the following aspects:

Aspect 1: A system for breaking safety glass, the system comprising: a support plate having first and second opposed sides, a glass breaking component configured to connect to the support plate, the glass breaking component comprising: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass.

Aspect 2: The system of any preceding aspect, wherein the glass breaking component is integrally or mechanically attached to the support plate.

Aspect 3: The system of any preceding aspect, wherein the glass breaking component is detachably connected to the support plate.

Aspect 4: The system of any preceding aspect, wherein the glass breaking component is connected to the support plate by a fitting, insert, threading, friction fit, snap-fit, adhesive, welding, or other suitable type of attachment mechanism, or by other features that makes the state of two mechanisms or functions mutually dependent.

Aspect 5: The system of any preceding aspect, wherein the glass breaking component is connected to the support plate by a connecting means, the connecting means comprising a fitting, insert, fastener, adhesive, brazing, soldering, welding, spot weld, or rivet, or a combination thereof.

Aspect 6: The system of any preceding aspect, wherein the base of the glass breaking component is integrally or mechanically attached to the support plate.

Aspect 7: The system of any preceding aspect, wherein the base of the glass breaking component is detachably connected to the support plate.

Aspect 8: The system of any preceding aspect, wherein the first side of the base is connected to a side of the support plate.

Aspect 9: The system of any preceding aspect, wherein the second side of the base is connected to a side of the support plate.

Aspect 10: The system of any preceding aspect, wherein the support plate comprises a port configured to receive the base of the glass breaking component.

Aspect 11: The system of any preceding aspect, wherein the port comprises at least one side wall and a bottom wall, and wherein the walls define an open cavity configured to receive the base of the glass breaking component.

Aspect 12: The system of any preceding aspect, wherein the port comprises an inner cylindrical wall and a bottom wall, and wherein the walls define an open cavity configured to receive the base of the glass breaking component.

Aspect 13: The system of any preceding aspect, wherein the base of the glass breaking component is connected to the support plate by inserting the base into the support plate port.

Aspect 14: The system of any preceding aspect, wherein the base and the support plate port are connected by a fitting, insert, fastener, threading, friction fit, snap-fit, adhesive, welding, or other suitable type of attachment mechanism.

Aspect 15: The system of any preceding aspect, wherein a portion of the base is externally threaded and the port is internally threaded.

Aspect 16: The system of any preceding aspect, wherein the base comprises an insert, and the base is connected to the support plate by inserting the insert into the port of the support plate.

Aspect 17: The system of any preceding aspect, wherein the base comprises a threaded insert, and wherein the port comprises a threaded portion, and wherein the threaded insert is threadably connected to the threaded portion of the port.

Aspect 18: The system of any preceding aspect, wherein the member is connected to the first side of the base, and the second side of the base is connected to a side of the support plate.

Aspect 19: The system of any preceding aspect, wherein the support plate comprises at least one aperture.

Aspect 20: The system of any preceding aspect, wherein the at least one aperture is configured to receive the member of the glass breaking component.

Aspect 21: The system of any preceding aspect, where in the bottom wall of the port comprises a plurality of apertures.

Aspect 22: The system of any preceding aspect, wherein the bottom wall comprises at least one aperture configured to receive the member of the glass breaking component, and at least one aperture configured to connect the base to the support plate by a connecting means.

Aspect 23: The system of any preceding aspect, wherein at least one aperture comprises a cylindrical inner wall, and wherein the inner wall defines an opening for receiving the member.

Aspect 24: The system of any preceding aspect, wherein at least one aperture comprises a cylindrical inner wall, and wherein the inner wall defines an opening for the connecting means.

Aspect 25: The system of any preceding aspect, wherein the member is connected to the first side of the base, and a side of the support plate is connected to the first side of the base.

Aspect 26: The system of any preceding aspect, wherein the first side of the base is connected to a first side of the support plate, and wherein the member is extended through an aperture from the first side of the support plate to a second side of the support plate.

Aspect 27: The system of any preceding aspect, wherein the first side of the base is connected to a first side of the support plate, wherein the member is extended through a first aperture from the first side of the support plate to a second side of the support plate, and wherein the base is connected to the support plate by extending a connecting means through a second aperture from the second side of the support plate to the first side of the base.

Aspect 28: The system of any preceding aspect, wherein the base is connected to the support plate by extending a plurality of connecting means through a plurality of second apertures from the second side of the support plate to the first side of the base.

Aspect 29: The system of any preceding aspect, wherein the connecting means are attached to a surface of the base.

Aspect 30: The system of any preceding aspect, wherein the base comprises at least one aperture.

Aspect 31: The system of any preceding aspect, wherein the at least one aperture is configured to receive a connecting means.

Aspect 32: The system of any preceding aspect, wherein the base comprises a plurality of apertures.

Aspect 33: The system of any preceding aspect, wherein the base comprises at least one aperture configured to connect the base to the support plate by a connecting means.

Aspect 34: The system of any preceding aspect, wherein at least one aperture comprises a cylindrical inner wall, and wherein the inner wall defines an opening for the connecting means.

Aspect 35: The system of any preceding aspect, wherein the first side of the base is connected to a first side of the support plate, and wherein the member is extended through an aperture from the first side of the support plate to a second side of the support plate.

Aspect 36: The system of any preceding aspect, wherein the base is connected to the support plate by extending the connecting means through at least one aperture of base to the support plate.

Aspect 37: The system of any preceding aspect, wherein the first side of the base is connected to a first side of the support plate, and wherein the base is connected to the support plate by extending the connecting means through at least one base aperture from the second side of the base to the first side of the support plate.

Aspect 38: The system of any preceding aspect, wherein the base is connected to the support plate by extending a plurality of connecting means through a plurality of apertures of the base to the support plate.

Aspect 39: The system of any preceding aspect, wherein the base is connected to the support plate by extending a plurality of connecting means through a plurality of apertures from the second side of the base to the first side of the support plate.

Aspect 40: The system of any preceding aspect, wherein the glass breaking component comprises a plurality of members.

Aspect 41: The system of any preceding aspect, wherein the member comprises a spike, pin, or radius point, or a combination thereof.

Aspect 42: The system of any preceding aspect, wherein the member has a height in the range of from about 10 mm to about 100 mm.

Aspect 43: The system of any preceding aspect, wherein the member comprise a shaft portion disposed between the first and second ends.

Aspect 44: The system of any preceding aspect, wherein the member comprises a cylindrical body.

Aspect 45: The system of any preceding aspect, wherein the glass cutting portion comprises tapered or cone shape.

Aspect 46: The system of any preceding aspect, wherein the glass cutting portion comprises a plurality of tapered surfaces.

Aspect 47: The system of any preceding aspect, wherein the glass cutting portion has a height in the range of from about 1 mm to about 30 mm.

Aspect 48: The system of any preceding aspect, wherein the glass cutting portion has a cone angle in the range of from about 30 degrees to about 80 degrees.

Aspect 49: The system of any preceding aspect, wherein the glass cutting portion has a taper angle in the range of from about 30 degrees to about 80 degrees.

Aspect 50: The system of any preceding aspect, wherein the glass cutting portion comprises a plurality of glass cutting edges.

Aspect 51: The system of any preceding aspect, wherein the glass cutting portion comprises a void, the void comprises an inner cylindrical wall and a bottom wall, wherein the walls define an open cavity, and wherein the upper portion of the inner wall defines a glass cutting edge.

Aspect 52: The system of any preceding aspect, where in the base comprises a disc shape.

Aspect 53: The system of any preceding aspect, wherein the base has a diameter of in the range of from about 10 mm to about 100 mm.

Aspect 54: The system of any preceding aspect, wherein the glass breaking component has a weight in the range of from about 1 gram to about 100 grams.

Aspect 55: The system of any preceding aspect, wherein the glass breaking component is comprised of a hardened material.

Aspect 56: The system of any preceding aspect, wherein the glass breaking component is comprised of a metal, or ceramic, or amorphous alloy, or a combination thereof.

Aspect 57: The system of any preceding aspect, wherein a portion of the support plate comprises a recess, the recess being contained within an outer edge of the support plate.

Aspect 58: The system of any preceding aspect, further comprising a cutting mechanism within the support plate, the cutting mechanism being mounted within the recess.

Aspect 59: The system of any preceding aspect, wherein the cutting mechanism is configured to cut a car safety belt.

Aspect 60: The system of any preceding aspect, wherein the support plate is comprised of plastic, metal, or amorphous alloy, or a combination thereof.

Aspect 61: The system of any preceding aspect, wherein the support plate is comprised of ABS, or composite, or a combination thereof.

Aspect 62: The system of any preceding aspect, wherein the support plate comprises a rectangular shape.

Aspect 63: The system of any preceding aspect, wherein the support plate comprise a length of less than about 100 mm.

Aspect 64: The system of any preceding aspect, wherein the support plate comprise a width of less than about 100 mm.

Aspect 65: The system of any preceding aspect, wherein the support plate comprises a size of a credit card.

Aspect 66: The system of any preceding aspect, wherein the support plate comprise a length of less than about 85 mm, and a width of less than about 50 mm.

Aspect 67: The system of any preceding aspect, wherein the support plate has a thickness in the range of from about 1 mm to about 10 mm.

Aspect 68: The system of any preceding aspect, wherein the support plate has a thickness of less than about 10 mm.

Aspect 69: The system of any preceding aspect, wherein the support plate has a weight in the range of from about 1 gram to about 100 grams.

Aspect 70: The system of any preceding aspect, wherein the support plate is configured to be detachably attached to a surface of a safety glass panel.

Aspect 71: The system of any preceding aspect, wherein the support plate is configured to be detachably attached to a surface of a safety glass panel on the inside of a car window.

Aspect 72: The system of any preceding aspect, wherein the support plate is configured to be held against the glass surface by using a car window structure.

Aspect 73: The system of any preceding aspect, wherein the support plate is configured to be held in place by a car window channel or trim.

Aspect 74: The system of any preceding aspect, further comprising an adhesion layer.

Aspect 75: The system of any preceding aspect, wherein the adhesion layer is configured to adhere to the surface of a safety glass panel.

Aspect 76: The system of any preceding aspect, wherein the adhesion layer is on a portion of the surface of the support plate.

Aspect 77: The system of any preceding aspect, further comprising a pull tab connected to the support plate.

Aspect 78: The system of any preceding aspect, wherein the pull tab is connected to an outer edge of the support plate.

Aspect 79: The system of any preceding aspect, wherein the system is configured to strike the glass surface using the member.

Aspect 80: The system of any preceding aspect, wherein the system is configured to drive the glass breaking portion of the member into the glass surface in response to a user delivering the required force to the glass breaking component.

Aspect 81: The system of any preceding aspect, wherein the required force to break the glass is less than about 10 lbs.

Aspect 82: The system of any preceding aspect, wherein the required force to break the glass is less than about 5 lbs.

Aspect 83: The system of any preceding aspect, wherein the system can be operated to break the safety glass using a single finger or hand.

Aspect 84: The system of any preceding aspect, wherein the force is delivered by pressing on the base of the glass breaking component.

Aspect 85: The system of any preceding aspect, wherein the force is delivered by pulling the support plate and glass breaking component away from the glass surface to a predetermined distance and releasing the support plate and glass breaking component, thereby causing the support plate and glass breaking component to snap back towards and strike the glass surface.

Aspect 86: The system of any preceding aspect, wherein when the support plate and glass breaking component strike the glass surface, the glass breaking portion is configured to the drive the glass cutting edge into the glass surface, thereby fracturing the glass.

Aspect 87: The system of any preceding aspect, wherein the predetermined distance is less than about 100 mm.

Aspect 88: The system of any preceding aspect, wherein the predetermined distance is less than about 10 mm.

Aspect 89: The system of any preceding aspect, wherein the glass cutting edge is raised off the glass surface a distance of less than about 100 mm.

Aspect 90: The system of any preceding aspect, wherein the glass cutting edge is raised off the glass surface a distance of less than about 10 mm.

Aspect 91: The system of any preceding aspect, wherein the entire glass panel is fractured.

Aspect 92: The system of any preceding aspect, wherein the entire glass panel is fracture in less than about 0.5 seconds.

Aspect 93: The system of any preceding aspect, wherein the entire glass panel is fracture in less than about 0.3 seconds.

Aspect 94: The system of any preceding aspect, wherein the support plate is pulled away from the glass surface using an outer edge of the support plate or a pull tab.

Aspect 95: The system of any preceding aspect, wherein the pull pressure exerted on the outer edge of the support plate is less than about 10 lbs.

Aspect 96: The system of any preceding aspect, wherein the pull pressure exerted on the outer edge of the support plate is less than about 5 lbs.

Aspect 97: The system of any preceding aspect, wherein the system is configured to spall or fracture an entire glass panel.

Aspect 98: The system of any preceding aspect, wherein the system utilizes a resonance frequency to fracture the glass panel.

Aspect 99: The system of aspect 98, wherein the frequency is a 4 kHz low end frequency.

Aspect 100: The system of any preceding aspect, wherein the system uses harmonic utilization of increasing sine wave amplitude for initiation of wave fracturing.

Aspect 101: The system of any preceding aspect 100, wherein the harmonic is the 1st, 3rd, 5th, 7th, 9th, or 11th, or a combination thereof.

Aspect 102: The system of any preceding aspect, wherein the system uses ultrasonic frequency for initiation of wave fracturing.

Aspect 103: The system of aspects, wherein ultrasound frequency is delivered using a piezo ceramic member.

Aspect 104: The system of any preceding aspect, wherein ultrasound frequency for initiating spontaneous fracturing is 8 kHz, 12 kHz, 16 kHz, or 20 kHz, or a combination thereof.

Aspect 105: The system of any preceding aspect, wherein the system uses a resonance condition or constructive interference occurs when two waves are phase corresponding to 2TT, 4TT, or the like.

Aspect 106: A method for breaking safety glass, the method comprising: a) providing a glass breaking device, the device comprising: a support plate having first and second opposed sides, a glass breaking component configured to connect to the support plate, the glass breaking component comprising: a base having first and second opposed sides, and a member having first and second opposed ends, the first end of the member connected to and extending from at least one side of the base and the second end of the member comprising a glass breaking portion, the glass breaking portion having at least one glass cutting edge and configured to break safety glass; and b) providing the required force to the glass breaking component to drive the glass breaking portion of the member into a surface of the safety glass.

Aspect 107: The method of aspect 106, further comprising attaching the support plate to a surface of a safety glass.

Aspect 108: The method of any preceding aspect, further comprising attaching the support plate to a surface of a safety glass panel on the inside of a car window.

Aspect 109: The method of any preceding aspect, further comprising attaching the support plate the glass surface using a car window structure.

Aspect 110: The method of any preceding aspect, further comprising attaching the support plate to the glass surface using a car window channel or trim.

Aspect 111: The method of any preceding aspect, wherein the force is provided by pressing on the base of the glass breaking component.

Aspect 112: The method of any preceding aspect, wherein the force is provided by pulling the support plate and glass breaking component away from the glass surface to a predetermined distance and releasing the support plate and glass breaking component, thereby causing the support plate and glass breaking component to snap back towards and strike the glass surface.

Aspect 113: The method of any preceding aspect, wherein when the support plate and glass breaking component strike the glass surface, the glass breaking portion is configured to drive the glass cutting edge into the glass surface, thereby fracturing the safety glass.

Aspect 114: The method of any preceding aspect, wherein force is provided using a single finger or hand.

Aspect 115: The method of any preceding aspect, wherein the required force to break the glass is less than about 10 lbs.

Aspect 116: The method of any preceding aspect, wherein the required force to break the glass is less than about 5 lbs.

Aspect 117: The method of any preceding aspect, wherein the support plate is pulled away from the glass surface using an outer edge of the support plate.

Aspect 118: The method of any preceding aspect, wherein the pull pressure exerted on the outer edge of the support plate is less than about 10 lbs.

Aspect 119: The method of any preceding aspect, wherein the pull pressure exerted on the outer edge of the support plate is less than about 5 lbs.

Aspect 120: The method of any preceding aspect, wherein the predetermined distance is less than about 100 mm.

Aspect 121: The method of any preceding aspect, wherein the predetermined distance is less than about 10 mm.

Aspect 122: The method of any preceding aspect, wherein the glass cutting edge is raised off the glass surface a distance of less than about 100 mm.

Aspect 123: The method of any preceding aspect, wherein the glass cutting edge is raised off the glass surface a distance of less than about 10 mm.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A device for breaking safety glass, the device comprising:

a card-shaped support plate having a first opposed side, a second opposed side, a bottom end, and a top end having a thickness capable of being placed between a safety glass and a window structure, said card-shaped support plate having the ability to bend and return to its previous state and having a recess sufficient to receive a glass breaking component, the glass breaking component connected to the support plate, the glass breaking component comprising:

a base having first and second opposed sides, and a member having first and second opposed ends, the first end of the member connected to and extending from at least one side of the base and the second end of the member comprising a glass breaking portion facing away from the base, the glass breaking portion having at least one glass cutting edge and configured to break safety glass by placing the top end of the support plate between the safety glass and a window structure, pulling the support plate away from the glass, and releasing the support plate, thereby causing the glass breaking component to strike the safety glass.

2. The device of claim 1, wherein the glass breaking component is integrally or mechanically attached to the support plate.

3. The device of claim 1, wherein the member is connected to the first side of the base, and the second side of the base is connected to a side of the support plate.

4. The system of claim 1, wherein the recess of the support plate comprises at least one aperture.

5. The device of claim 4, wherein the at least one aperture is configured to receive the member of the glass breaking component or connect the base of the glass breaking component to the support plate by a connecting means, or a combination thereof.

6. The system of claim 1, wherein the glass breaking component comprises a plurality of members.

7. The device of claim 1, wherein the member comprises a spike, pin, needle, or radius point, or a combination thereof.

8. The device of claim 1, wherein the base comprises a disc or circular shape.

9. The device of claim 1, wherein the device has a weight in the range of from about 1 gram to about 100 grams.

10. The device of claim 1, wherein a second portion of the support plate comprises a second recess, the second recess being contained within an outer edge of the support plate and comprising a cutting mechanism within the support plate, the cutting mechanism being mounted within the recess.

11. The device of claim 1, wherein the card-shaped support plate comprises a length of less than about 100 mm, a width of less than about 100 mm, or a thickness of less than about 10 mm, or a combination thereof and further comprises an overall shape from the group of shapes consisting of a rectangle, and rectangular shapes with rounded edges.

12. The device of claim 1, wherein the support plate is configured to be detachably attached to a surface of a safety glass panel on the inside of a car window.

13. The device of claim 1, wherein the system is configured to drive the glass breaking portion of the member into the glass surface in response to a user delivering the required force to the glass breaking component.

14. The device of claim 13, wherein the required force to break the glass is less than about 10 lbs.

15. The device of claim 14, wherein the force is delivered by pulling the support plate and glass breaking component away from the glass surface to a predetermined distance and releasing the support plate and glass breaking component, thereby causing the support plate and glass breaking component to snap back towards and strike the glass surface.

16. The device of claim 15, wherein the predetermined distance is less than about 100 mm.

* * * * *